US008984713B2

(12) United States Patent
Peterson

(10) Patent No.: US 8,984,713 B2
(45) Date of Patent: Mar. 24, 2015

(54) PORTABLE BLOWER WITH WEAR RESISTANT DISCHARGE END

(75) Inventor: Brent Peterson, Buffalo Grove, IL (US)

(73) Assignee: Echo, Inc., Lake Zurich, IL (US)

( * ) Notice: Subject to any disclaimer, the term of this patent is extended or adjusted under 35 U.S.C. 154(b) by 1186 days.

(21) Appl. No.: 12/911,077

(22) Filed: Oct. 25, 2010

(65) Prior Publication Data

US 2012/0099979 A1 Apr. 26, 2012

(51) Int. Cl.

| | |
|---|---|
| ***A47L 5/00*** | (2006.01) |
| ***A47L 9/08*** | (2006.01) |
| ***F04D 25/08*** | (2006.01) |
| ***F04D 29/02*** | (2006.01) |
| ***F04D 29/52*** | (2006.01) |

(52) U.S. Cl.

CPC ..... *F04D 25/084* (2013.01); *F04D 29/023* (2013.01); *F04D 29/522* (2013.01)

USPC ..... 15/405; 15/415.1

(58) Field of Classification Search

USPC ..... 15/405, 344, 415.1, 328

See application file for complete search history.

(56) References Cited

U.S. PATENT DOCUMENTS

| | | | | | |
|---|---|---|---|---|---|
| 5,584,436 | A | * | 12/1996 | Sepke | 239/154 |
| 5,711,048 | A | * | 1/1998 | Pink et al. | 15/347 |
| 5,722,111 | A | * | 3/1998 | Sowell et al. | 15/330 |
| 5,768,749 | A | * | 6/1998 | Ohi et al. | 15/405 |
| 5,926,910 | A | | 7/1999 | Nishimura et al. | |
| 6,003,199 | A | * | 12/1999 | Shaffer | 15/405 |
| 6,076,231 | A | * | 6/2000 | Bucher | 15/405 |
| 7,739,773 | B2 | | 6/2010 | Schliemann et al. | |
| 2010/0257694 | A1 | * | 10/2010 | Weihl et al. | 15/405 |

* cited by examiner

*Primary Examiner* — Robert Scruggs

(74) *Attorney, Agent, or Firm* — Wood, Phillips, Katz, Clark & Mortimer

(57) ABSTRACT

A portable blower having a propulsion unit for continuously generating a supply of pressurized fluid and a conduit assembly for controllably directing fluid from the propulsion unit to and through a discharge opening on the conduit assembly. The discharge opening is bounded by a rim, defined at least partially by a discrete component made from a first material. The conduit assembly has a first portion made from a second material to which the discrete component is operatively connected. The first material is at least one of: a) more resistant to abrasive wear than the second material; b) more resistant to impact than the second material; and c) harder than the second material.

23 Claims, 8 Drawing Sheets

PORTABLE BLOWER WITH WEAR RESISTANT DISCHARGE END

BACKGROUND OF THE INVENTION

1. Field of the Invention

This invention relates to portable fluid blowers and, more particularly, to blowers that have a discharge end that can be controllably positioned by a user.

2. Background Art

Portable blowers have been used, particularly in the landscaping area, for decades. Common to these designs is the ability of a user to control placement of the fluid discharge end so as to select both discharge flow direction and location.

The portable configurations vary widely. As one example, a portable blower may be configured as shown in FIG. 1 of U.S. Pat. No. 5,926,910, wherein a housing containing the propulsion components is directly held by a user. A discharge conduit is in fixed relationship to the housing so that the user is required to reorient the entire apparatus as a unit to control air discharge.

In an alternative form, as shown in FIG. 7 of U.S. Pat. No. 6,077,033, a flexible conduit is provided to communicate air from a propulsion unit to an opening at the discharge end of a nozzle. The user exploits the flexibility of the conduit to control direction and location of the air discharge.

Common to virtually all designs is the provision of a nozzle with a discharge opening and a rim that extends around the opening and bounds a shape and area determinative of discharge volume and flow velocity. These units are commonly designed with the capacity of the propulsion unit matched to the conduit and discharge opening to generate air flow volume and velocity that are considered to be optimal. So long as the discharge opening, as determined by the rim shape, remains constant in configuration, the unit will have consistent operating characteristics.

Commonly, the rim defining the discharge opening area is integral with a length of conduit or a nozzle fitting attached appropriately to a conduit. Most commonly, the conduits and all associated fittings communicating air between the propulsion unit and the discharge opening, including the rim at the discharge end, are made from plastic material. This material selection is made primarily for weight minimization, particularly since most units are designed to be held by a user in an elevated position during use. Available plastics also generally have good durability.

However, a typical blower used by a landscaping crew may, over an extended period, experience significant wear. One area of concern is with the rim at the discharge end of the conduit or nozzle fitting. The exposed region of the rim may be repeatedly impacted against hard surfaces or dragged on those surfaces, as a result of which there may be progressive wear that changes the configuration of the rim and thereby potentially the effective area and/or shape of the discharge opening that it bounds. Whereas, when new, the capacity of the propulsion unit and the area and shape of the discharge opening are closely matched to optimize performance, over time this relationship may be altered as a result of which air discharge patterns, velocity, and/or volume may be detrimentally affected.

For the most part, changes in operating characteristics attributable to a reconfiguration of the rim at the discharge end of the conduit or nozzle fitting, due to wear, may be gradual. As a result, the user may not even detect any performance compromise and may eventually attribute less than optimal performance to the original unit design. This may reflect poorly on the manufacturer when, in fact, the compromised performance due to regular anticipated wear may be inevitable with all of these types of blowers.

As a practical matter, those using blowers of this type on a daily basis are unlikely to be monitoring the condition of the rim at the discharge end. Even if regular monitoring is undertaken, replacement of part or all of the assembly communicating between the propulsion unit and the discharge end may be an inconvenience and represent a significant expense. This is aggravated by the fact that the rim at the discharge end may often be integrated with other conduit and fitting components so that the replacement part(s) may be somewhat expensive.

The reality is that users of portable blowers, particularly in the landscape industry, are not likely to regularly maintain the air communication components between the propulsion unit and the discharge end. Rather, they eventually contend with compromised unit performance which may translate into additional time needed to perform routine landscaping tasks or performance of tasks in an ineffective manner.

The industry continues to seek out improvements in this type of equipment that will contribute to greater product life without significantly increasing either the weight or cost of such equipment.

SUMMARY OF THE INVENTION

In one form, the invention is directed to a portable blower including a propulsion unit for continuously generating a supply of pressurized fluid and a conduit assembly for controllably directing fluid from the propulsion unit to and through a discharge opening on the conduit assembly. The discharge opening is bounded by a rim. The rim is defined at least partially by a discrete component made from a first material. The conduit assembly has a first portion made from a second material to which the discrete component is operatively connected. The first material is at least one of: a) more resistant to abrasive wear than the second material; b) more resistant to impact than the second material; and c) harder than the second material.

In one form, the discrete component is in the form of a ring.

In one form, the ring has a central axis, a diameter, and an axial length and the diameter is greater than the axial length of the ring.

In one form, air moving through the discharge opening moves in a first line. The first portion of the conduit assembly defines a first edge on the rim facing in one direction generally parallel to the first line. The discrete component defines a second edge that abuts to the first edge with the discrete component operatively connected.

In one form, the ring has a third edge facing generally in the one direction and engages the first portion of the conduit assembly so that a part of the first portion of the conduit assembly is captively held between the second and third edges to thereby maintain the discrete component operatively connected.

In one form, the ring has another edge that is substantially the same as the third edge and another part of the first portion of the conduit assembly is captively held between the second and another edges that in conjunction with the second and third edges maintain the discrete component operatively connected.

In one form, the ring is configured so that the ring can be translated from a separated, preassembly position relative to the first portion of the conduit assembly into an assembled position as an incident of which the discrete component is placed in the operative state and the part of the first portion of the conduit assembly becomes captively held between the second and third edges.

In one form, the third edge is defined by a first cantilevered tab.

In one form, the third edge is configured to define spaced contact regions that each digs into the first portion of the conduit assembly.

In one form, at least one of the contact regions is defined at the apex of a "V" shape on the first cantilevered tab.

In one form, the first cantilevered tab has a perimeter edge that is in the shape of a "W" that defines the spaced contact regions.

In one form, the ring has an annular wall that extends around the first portion of the conduit assembly and the first cantilevered tab is formed by being struck from the annular wall.

In one form, the first portion of the conduit assembly is made from a non-metal material and the ring is made from a metal material.

In one form, the first portion of the conduit is made from high density polyethylene and the ring is made from steel.

In one form, the ring has at least two cantilevered tabs in addition to the first cantilevered tab that are configured the same, and function the same, as the first cantilevered tab.

In one form, the ring is made from material having a gauge on the order of 22.

In one form, the ring has an outside diameter of 2.5 to 3.5 inches.

In one form, air moving through the discharge opening moves in a first line, and the ring extends fully around the discharge opening and has transverse surface portions each extending continuously around the discharge opening.

In one form, the first portion of the conduit assembly defines an annular corner on the rim extending fully around the discharge opening and the ring overlies the annular corner.

In one form, the portable blower has a weight and size that allow the portable blower to be held and operated by a user in an elevated position. The conduit assembly is one of: a) configured so that the discharge opening is substantially fixed relative to the fluid propulsion unit whereby a user is required to reorient the portable blower to reposition the discharge opening relative to a surface against which fluid is to be propelled; and b) configured so that a user can selectively reposition the discharge opening relative to the fluid propulsion unit to reposition the discharge opening relative to a surface against which fluid is to be propelled.

DETAILED DESCRIPTION OF THE PREFERRED EMBODIMENT

Figure 1:
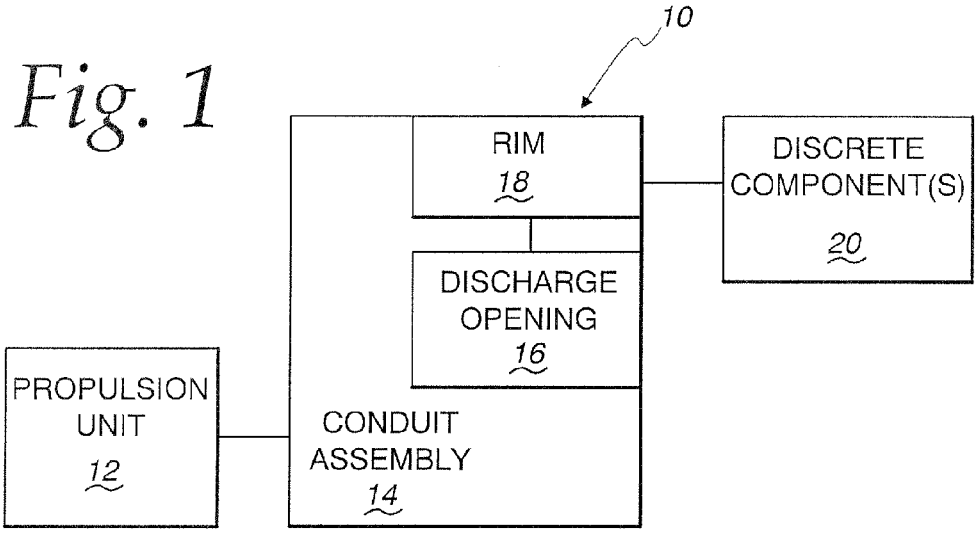
FIG. 1 is a schematic representation of a portable blower incorporating at least one discrete wear component according to the present invention.
Figure 2:
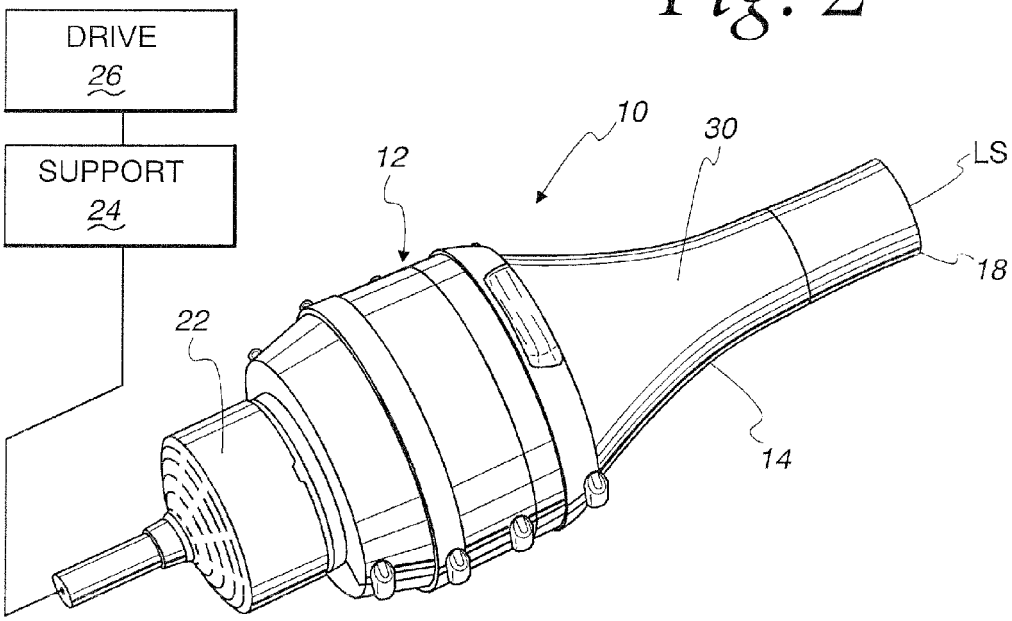
FIG. 2 is a partially schematic, perspective view of a specific form of portable blower, suitable for incorporation of the invention, without the at least one discrete component thereon.
Figure 3:
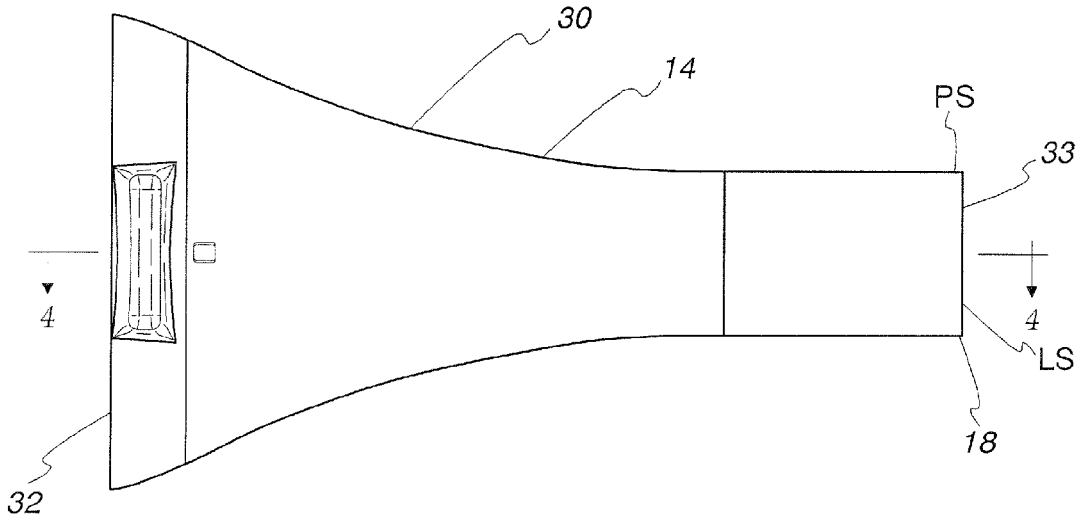
FIG. 3 is an enlarged, elevation view of a conduit assembly on the portable blower in FIG. 2.
Figure 4:
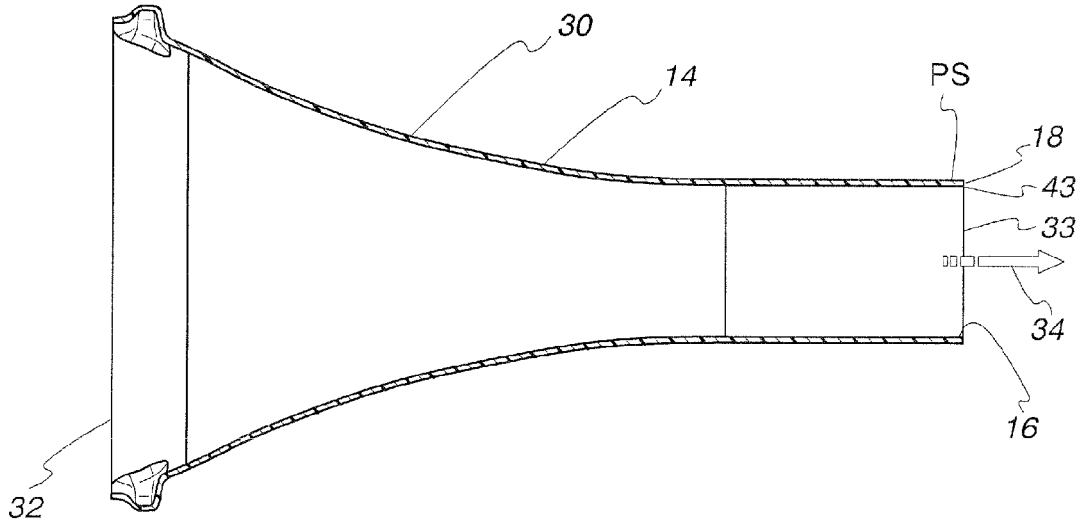
FIG. 4 is a cross-sectional view of the conduit assembly taken along line 4-4 of FIG. 3.
Figure 5:
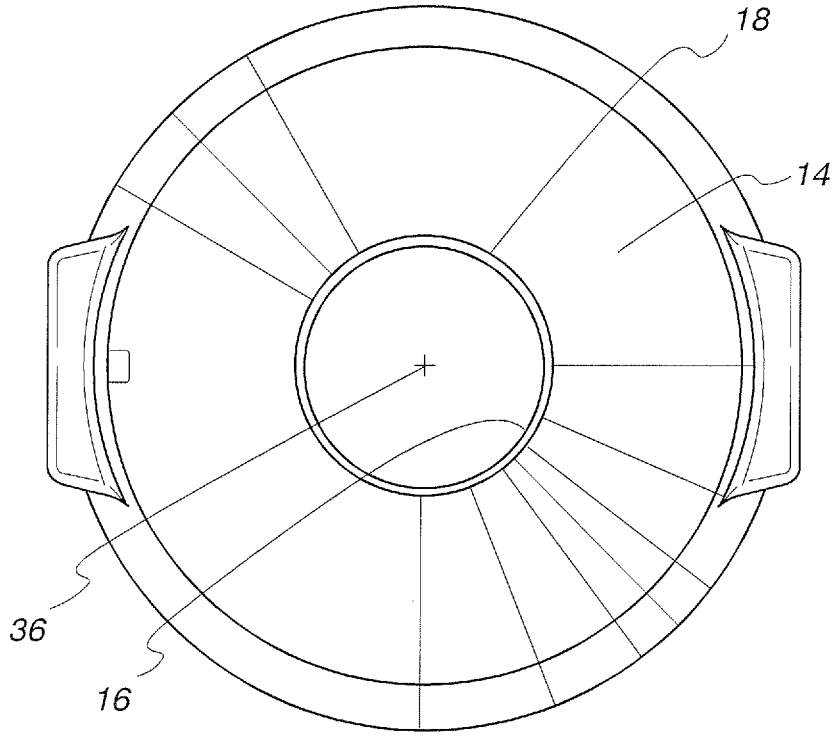
FIG. 5 is an enlarged, end elevation view of the conduit assembly in FIGS. 3 and 4.

In FIG. 1, a portable blower is shown at 10 incorporating the present invention. The schematic showing is intended to encompass blowers with virtually an unlimited number of different configurations. Common to each of these configurations is a propulsion unit 12 that continuously generates a supply of pressurized fluid—typically air—and a conduit assembly 14 for controllably directing fluid from the fluid propulsion unit 12 to and through a discharge opening 16 at a discharge end of the conduit assembly 14. The discharge opening 16 is bounded by a rim 18. According to the invention, the rim 18 is defined at least partially by at least one discrete component 20 made from a first material. The conduit assembly 14 has a first portion made from a second material to which the discrete component 20 is operatively connected. The first material is at least one of: a) more resistant to abrasive wear than the second material; b) more resistant to impact than the second material; and c) harder than the second material.

The schematic depiction of the portable blower 10 is intended to encompass specific configurations disclosed herein, other existing portable blower configurations, and those that might be devised to function as intended herein. Exemplary portable blowers are shown in U.S. Pat. Nos. 5,926,910 and 6,077,033.

In U.S. Pat. No. 5,926,910, the portable blower has a weight and size that allow it to be held in one hand of a user and operated by the user in an elevated position. The conduit assembly thereon is configured so that the discharge opening is substantially fixed relative to the fluid propulsion unit so that a user is required to reorient all components of the portable blower as a unit to reposition the discharge opening relative to a surface against which fluid is to be propelled.

In U.S. Pat. No. 6,077,033, the conduit assembly is configured so that a user can selectively reposition the discharge opening relative to the fluid propulsion unit and a surface against which fluid is to be propelled.

One specific form of portable blower 10 is the Assignee's own construction, as shown at 10 in FIGS. 2-6. The portable blower 10 consists of the aforementioned fluid propulsion unit 12, of a design specifically for air movement. The unit 12 has a housing 22 carried upon a manipulable support 24 that may be in the form of an elongate housing. A suitable drive 26 for the propulsion unit 12 is carried on the support 24 and is operable to cause the propulsion unit 12 to continuously generate pressurized air that is directed through the conduit assembly 14 that is in the form of a nozzle with a fixed configuration, secured to the housing 22. The conduit assembly 14 has an annular wall 30 that tapers progressively from an upstream end 32 to a downstream/discharge end 33 with the discharge opening 16 thereat that is shown to be circular in cross-section. The discharge opening 16 might have shapes other than circular, as well known to those in this art. The pressurized air is discharged in a first line, as indicated by the arrow 34, that is parallel to the central axis 36 of the conduit assembly 14.

In operation, the user will reposition the entire blower 10 to situate the discharge end 33, and discharge opening 16 thereat, at the desired location, with the blower 10 oriented selectively to additionally pick the optimal relationship of the flow direction to the surface against which the air is to be propelled, as to reposition loose matter thereon.

Typically, the rim 18 bounding the discharge opening 16 has exposed leading and peripheral surfaces LS, PS, respectively, that are guided against, or repetitively contact, surfaces against which fluid is propelled during operation of the blower 10.

Figure 6:
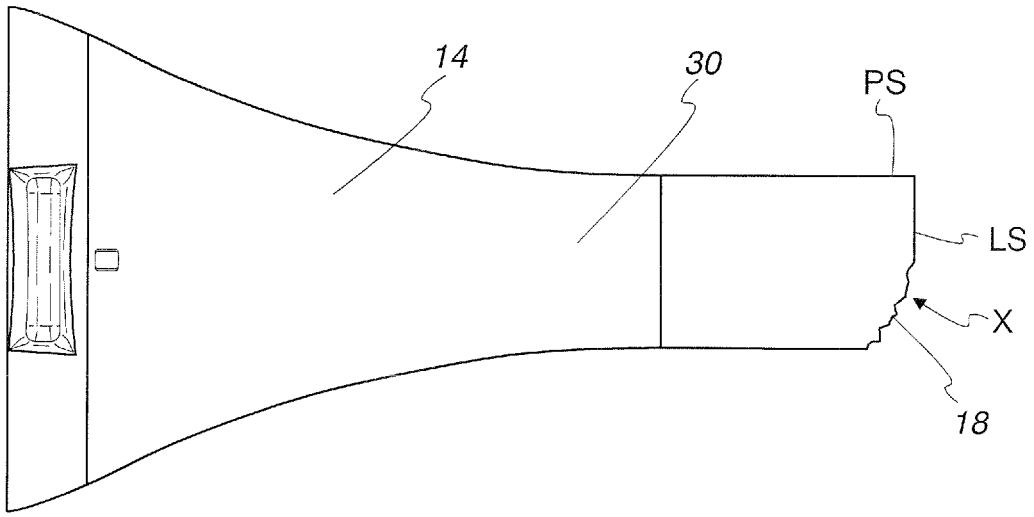
FIG. 6 is a view as in FIG. 3 wherein a portion of the conduit assembly at a discharge end thereof has been worn away, as through use.
Figure 7:
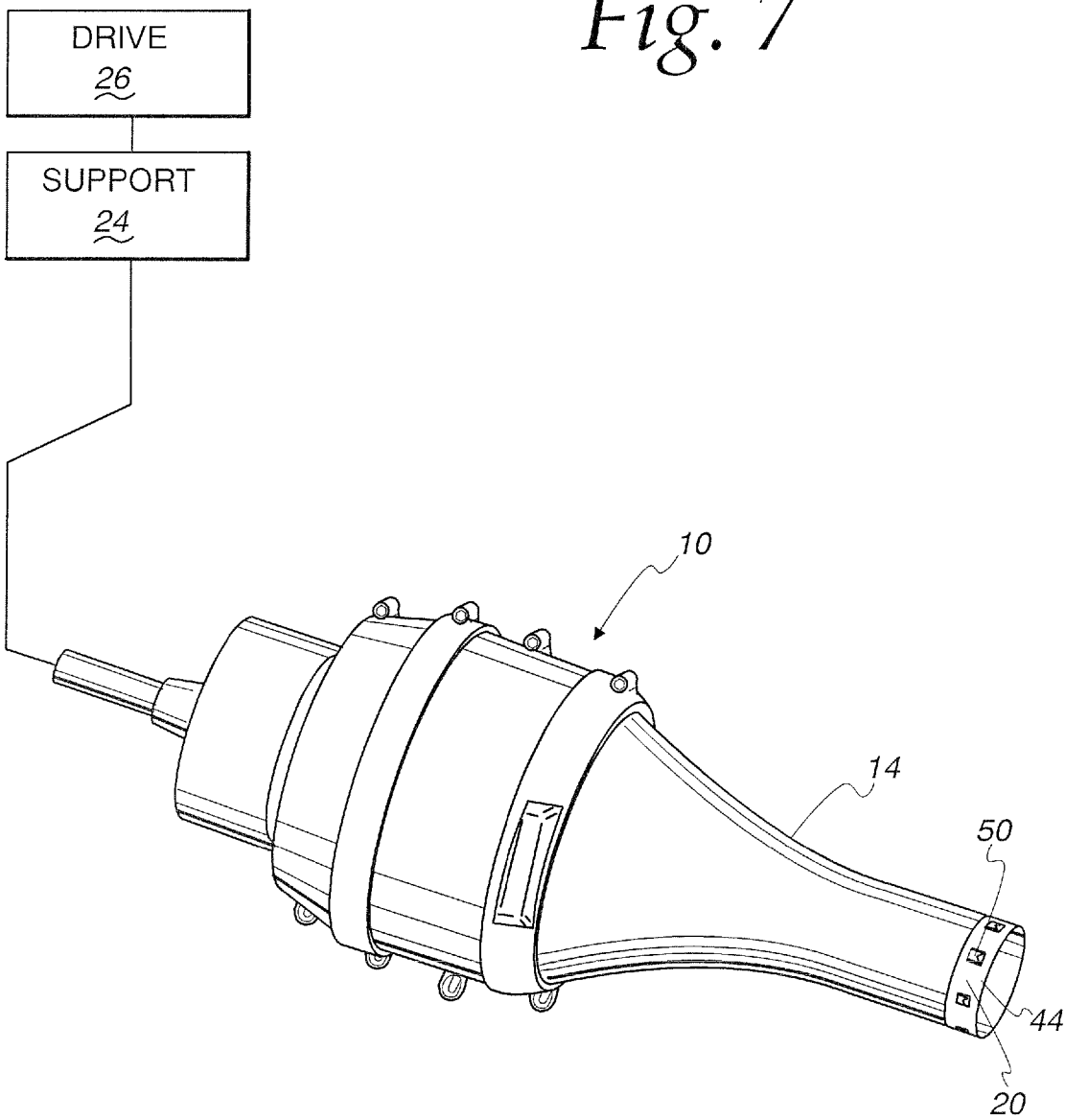
FIG. 7 is a partially schematic, perspective view of the portable blower in FIG. 2 from a different perspective and with a discrete component according to the invention and, in the form of a ring, operatively connected at a rim on the conduit assembly thereon.
Figure 8:
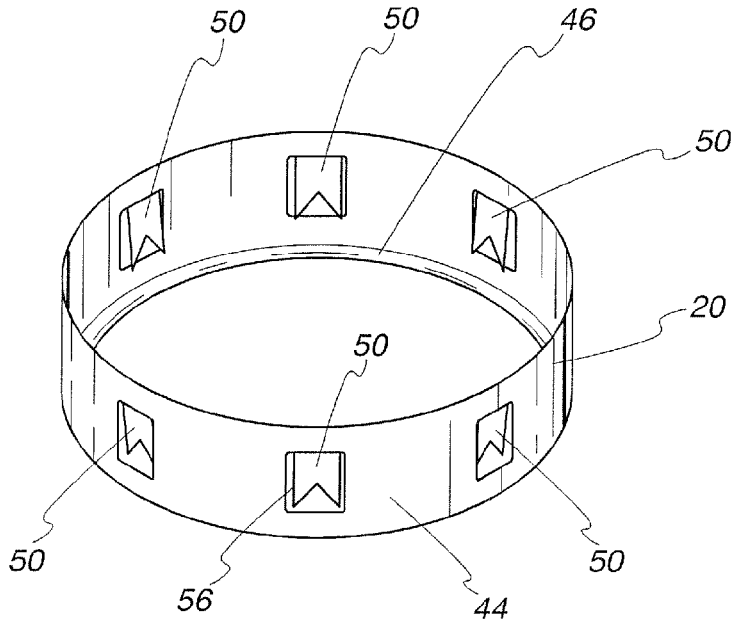
FIG. 8 is an enlarged, perspective view of the ring operatively connected to the portable blower in FIG. 7.

As shown in FIG. 6, eventually, portions of the rim 18, as indicated at X, may wear so that the discharge opening 16 has a different effective shape or area, with the latter generally larger than its initial area. As a result, the propulsion unit 12, designed to deliver pressurized air at a volume and speed optimally matched to the original shape and area of the discharge opening 16, is eventually directing air through a discharge opening 16 with larger area and/or different shape, as seen in FIG. 6. This may significantly change the operating characteristics for the portable blower 10.

To avoid this condition, the at least one discrete component 20 is incorporated into the portable blower 10, as shown in FIGS. 7-15. The discrete component 20 is in the form of a ring that is operatively connected to the aforementioned first portion 38 of the conduit assembly 14 at the rim 18. The ring 20 overlies the rim 18 to protect the same. The rim 18, as described and claimed herein, is considered to be that portion of the conduit assembly 14 that bounds the discharge opening 16 and includes a peripheral annular portion 40, surrounding the discharge opening 16 over a short axial extent, and an annular extremity 42 with an exposed surface/first edge 43 that faces axially of the conduit assembly 14. The rim 18 also includes the operatively connected ring 20.

With the ring 20 operatively connected, a peripheral wall 44 thereon surrounds an exposed outer surface portion 45 on the rim 18, with a second edge 46 on a wall 47 extending radially inwardly from the wall 44 and overlying the surface 43 on the extremity 42. Through this arrangement, the exposed ring 20 wraps around a corner at which the surface portion 45 and surface 43 meet and thereby overlies and shields the rim 18 to prevent any direct exposure of the surface portion 45 or surface 43 to a surface which the discharge end 33 of the conduit assembly 14 might otherwise contact during use. Optionally, the wall 47 might be eliminated; however, the edge 46 thereon is desirable for purposes of facilitating assembly, as explained hereinbelow.

Figure 10:
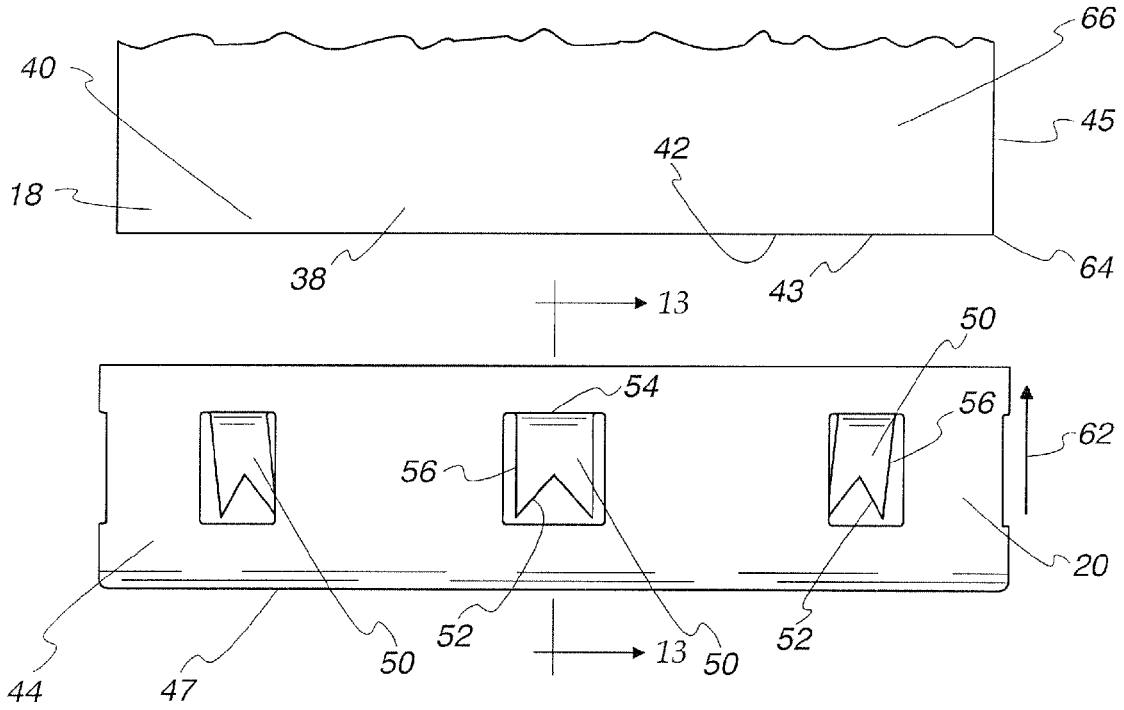
FIG. 10 is an enlarged, fragmentary, elevation view of the discharge end of the conduit assembly on the blower unit in FIG. 7 with the ring in a spaced, preassembly position relative thereto.
Figure 13:
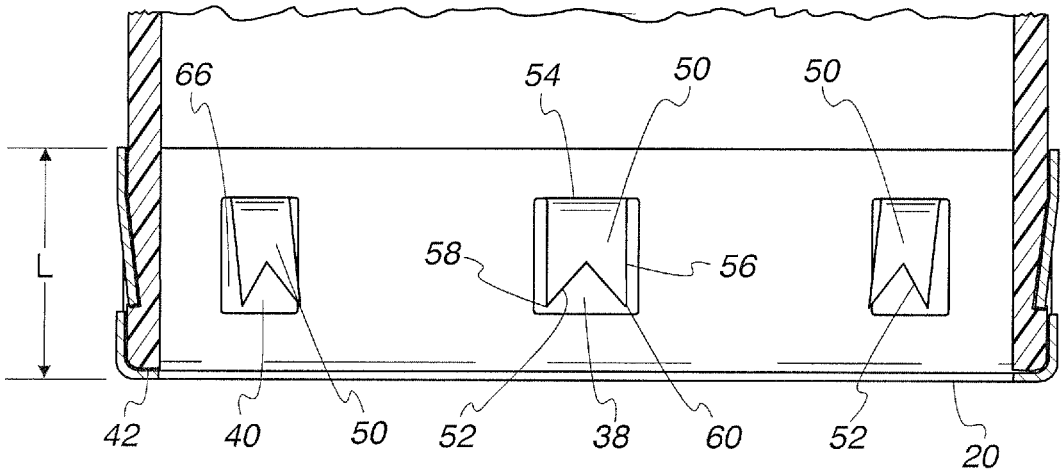
FIG. 13 is an enlarged, cross-sectional view of the discharge end of the conduit assembly with the ring operatively connected.

The ring 20 is designed to be press fit by being translated relative to the first portion 38 of the conduit assembly 14 from a separated, preassembly position, as shown in FIG. 10, into an assembled position, as shown in FIG. 13, as an incident of which the ring 20 becomes operatively connected and maintained in that state.

With the ring 20 operatively connected, the first edge 43 abuts to the second edge 46 on the ring 20. The first and second edges 43,46 are annular and face oppositely to abut so as to maintain the operatively connected ring 20 in the same axial position relative to the conduit assembly 14.

At least one, and in the depicted embodiment eight, cantilevered tabs 50 are formed on the ring 20. Each of the tabs 50 has the same construction and defines a third edge 52 that engages the first portion 38 of the conduit assembly 14 so that a part of the first portion 38 of the conduit assembly 14 is captively held between the second and third edges 46, 52, thereby to maintain the ring 20 operatively connected.

Each of the tabs 50 is struck directly from the peripheral wall 44 and is bent radially inwardly at an edge 54. The third edge 52 is part of a perimeter edge 56 that is in the shape of a "W". The third edge 52 is configured to define spaced contact regions 58, 60 at the apices of separate "V" shapes on the tabs 50.

Figure 12:
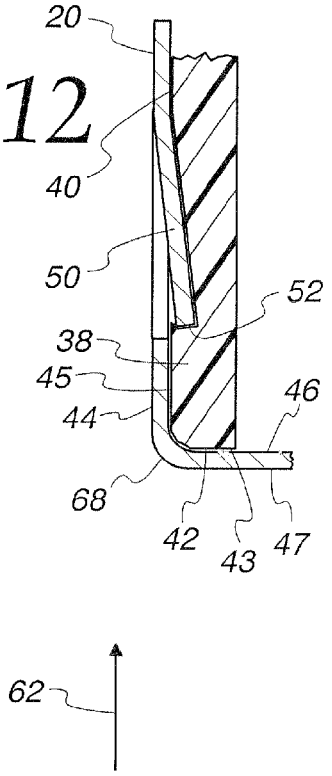
FIG. 12 is a view as in FIG. 11 with the ring advanced fully to the assembled position so that it is operatively connected.
Figure 14:
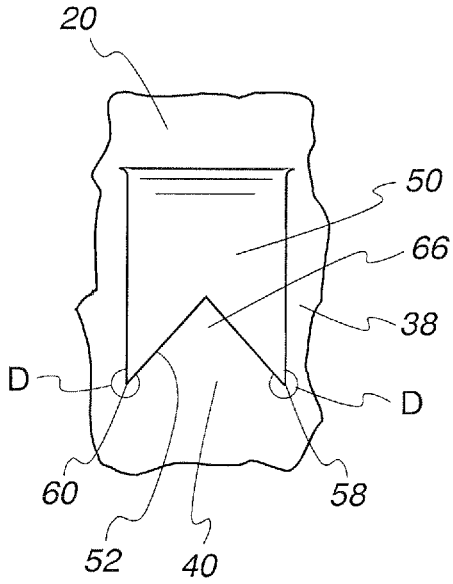
FIG. 14 is an enlarged, fragmentary, perspective view of one of the tabs on the ring interacting with a first portion of the conduit assembly with the ring operatively connected.
Figure 15:
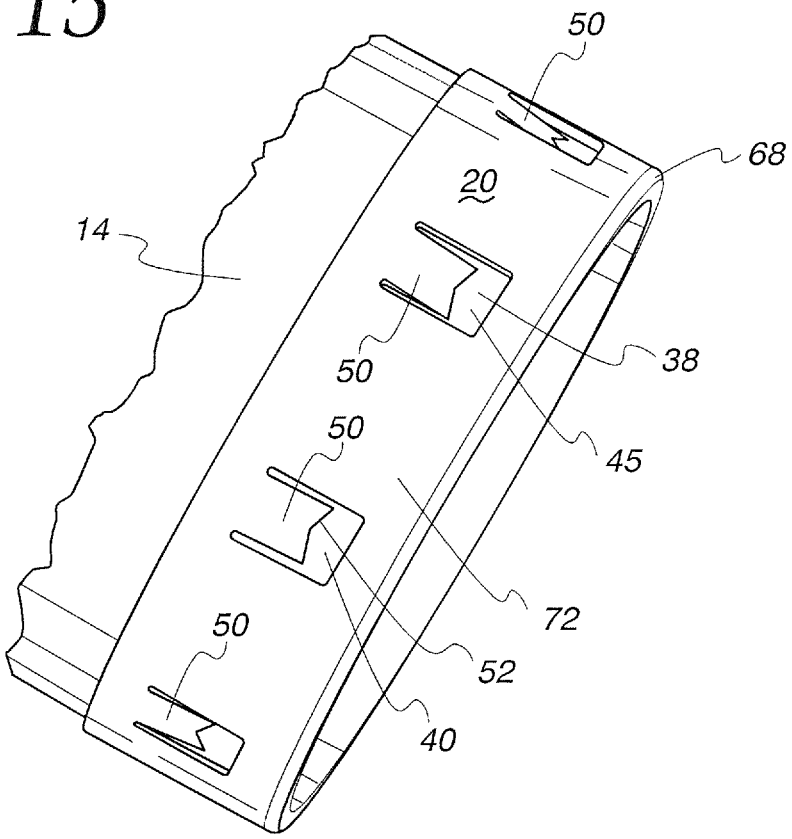
FIG. 15 is an enlarged, perspective view of the discharge end of the conduit assembly with the ring operatively connected.

The contact regions 58, 60 are configured to dig into the first portion 38 of the conduit assembly 14, as seen particularly in FIGS. 12 and 14, with the latter showing discrete depressions D in the first portion 38. This "digging" is somewhat exaggerated in FIGS. 12 and 14 for purposes of clarity.

Figure 11:
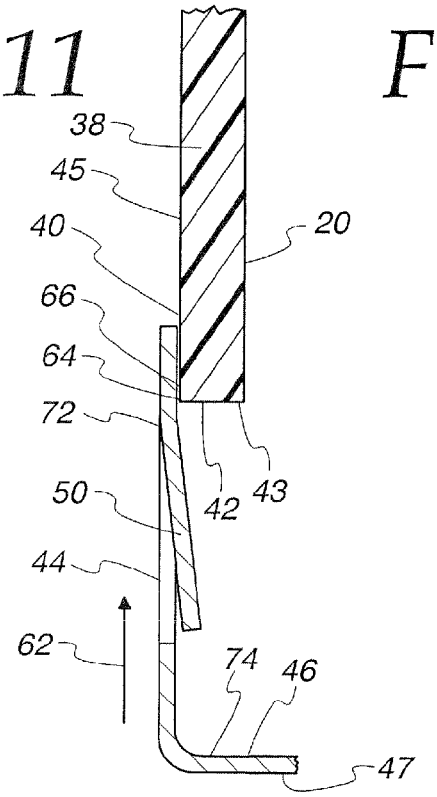
FIG. 11 is an enlarged, fragmentary, cross-sectional view showing part of the ring with a tab thereon being advanced from the FIG. 10 position towards an assembled position.

With the ring 20 in its separated position, as shown in FIG. 10, and concentric with the axis 36, the ring 20 can be translated towards the assembled position of FIG. 13 in a direction as indicated by the arrow 62. As seen in FIGS. 10 and 11, the outside corner 64 of the first portion 38 of the conduit assembly 14 encounters each tab 50 and progressively bends the tabs 50 radially outwardly. Residual forces in each bent tab 50 cause it to be urged radially inwardly towards the outer surface 66 of the first portion 38 of the conduit assembly 14. This force causes the relatively sharp contact regions 58, 60 to dig into the outer surface 66, thereby precluding subsequent reverse axial movement of the ring 20 that might allow its separation. Once the ring 20 is fully in its operative position with the edges 42, 46 in abutment, a part of the first portion 38 of the conduit assembly 14 becomes captive between the third edge 52 on each tab 50 and the annular second edge 46.

With the ring 20 operatively connected, the ring 20 defines an exposed annular corner 68 that nominally conforms to and overlies an annular corner 64 on the conduit assembly 14.

Figure 9:
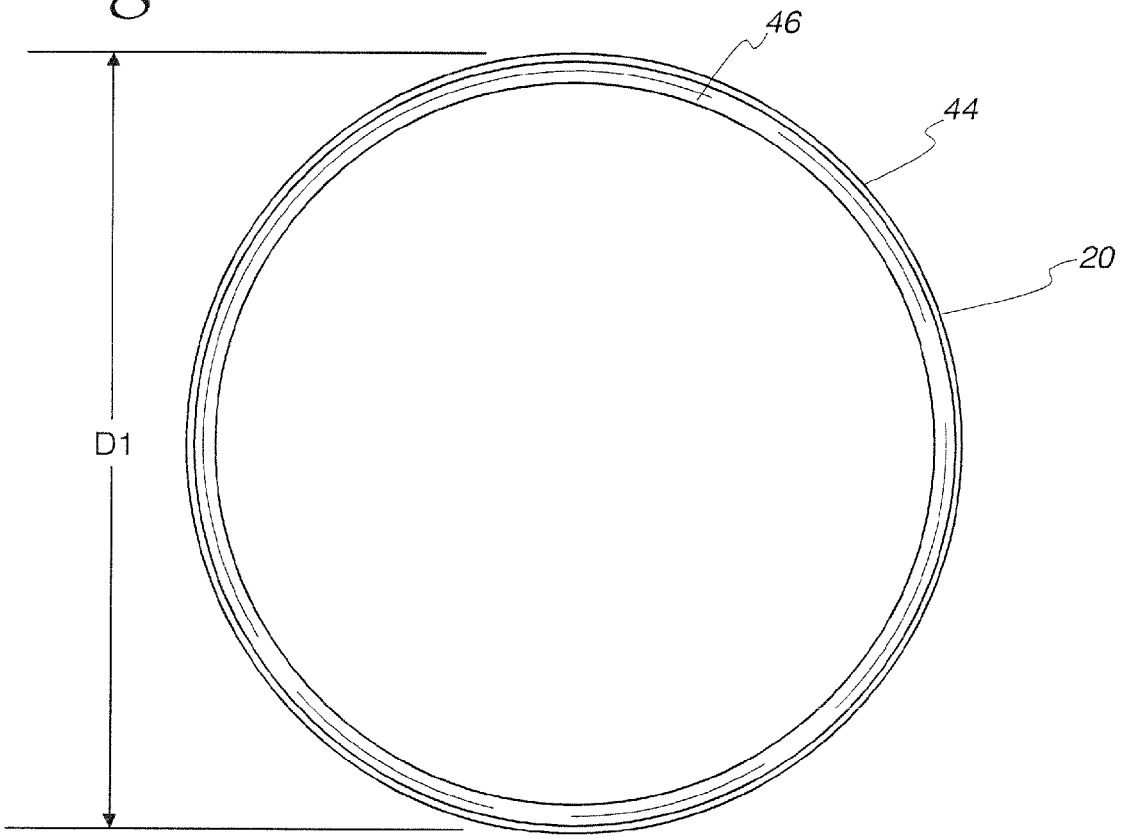
FIG. 9 is an enlarged, end view of the ring in FIGS. 7 and 8.

While the ring 20 can be assembled and perform the shielding function with an axial extent greater than shown, all that is necessary for the ring 20 to perform its intended function is to have sufficient axial extent to form the tabs 50, as described. As seen in FIGS. 9 and 13, the diameter D1 of the ring 20 is substantially greater than the axial length L thereof.

Typically, the main components of the conduit assembly 14 are made from a lightweight material that has good durability. For this purpose, non-metal materials are desired, such as high density polyethylene.

The ring 20 is preferably made from a metal material, such as steel. The metal material may have a gauge on the order of 22.

In one exemplary form, the outer diameter D1 of the ring is from 2.5 to 3.5 inches. However, this is a limitation that is very design specific, as the diameter could be virtually any size, including diameters substantially less than or greater than those within the above-noted range.

While the ring configuration is shown with exposed transverse portions 72, 74, respectively, on the wall 44 and edge 46, this precise relationship is not required.

Figure 16:
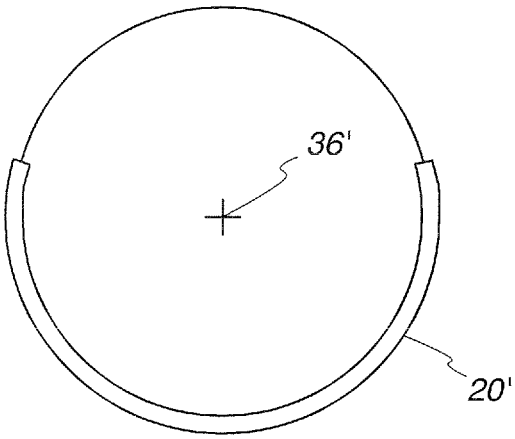
FIG. 16 is an end elevation view of a modified form of ring, according to the invention, operatively connected to a portion of a conduit assembly.

Further, as shown in FIG. 16, it is not required that the ring extend fully around its central axis. A modified form of ring 20' extends only partially around the corresponding axis 36'.

Figure 17:
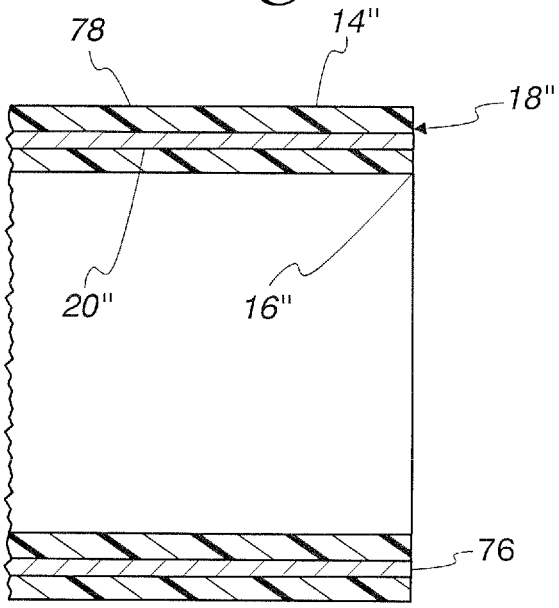
FIG. 17 is a cross-sectional view of a further modified form of ring, according to the invention and operatively connected to a conduit assembly.

As a further alternative configuration, as shown in FIG. 17, a ring 20" may be embedded in other components on the rim 18" on the conduit assembly 14". In this embodiment, the ring 20" is exposed directly only at its axial edge 76. Thus, if the overlying portion 78 is eventually worn away, the ring 20" on the rim 18" will become exposed and maintain the original shape and area of the discharge opening 16".

The foregoing disclosure of specific embodiments is intended to be illustrative of the broad concepts comprehended by the invention.

The invention claimed is:

1. A portable blower comprising:

a propulsion unit for continuously generating a supply of pressurized fluid; and a conduit assembly for controllably directing fluid from the propulsion unit to and through a discharge opening on the conduit assembly, the discharge opening having a central axis and a diameter, the discharge opening bounded by a rim, the rim defined at least partially by a discrete component made from a first material, the discrete component extending axially relative to the central axis a distance less than the diameter of the discharge opening, the conduit assembly comprising a first portion made from a second material to which the discrete component is operatively connected, the first material being at least one of: a) more resistant to abrasive wear than the second material; b) more resistant to impact than the second material; and c) harder than the second material, wherein the discrete component is in the form of a ring, wherein air moving through the discharge opening moves in a first line, the first portion of the conduit assembly defines a first edge on the rim facing in one direction generally parallel to the first line and the discrete component defines a second edge that extends transversely to the first line and abuts to the first edge with the discrete component operatively connected.

2. The portable blower according to claim 1 wherein the ring is fixed against axial movement relative to the rim.

3. The portable blower according to claim 2 wherein the ring extends around an outside surface of the first portion of the conduit assembly at the rim.

4. The portable blower according to claim 1 wherein the ring comprises a third edge facing generally in the one direction and engages the first portion of the conduit assembly so that a part of the first portion of the conduit assembly is captively held in a fixed relationship between the second and third edges to thereby maintain the discrete component operatively connected.

5. The portable blower according to claim 4 wherein the ring comprises another edge that is spaced from the third edge and substantially the same as the third edge and another part of the first portion of the conduit assembly is captively held in a fixed relationship between the second and another edges that in conjunction with the second and third edges maintain the discrete component operatively connected.

6. The portable blower according to claim 4 wherein the ring is configured so that the ring can be translated from a separated, preassembly position relative to the first portion of the conduit assembly into an assembled position as an incident of which the discrete component is placed in the operative state and the part of the first portion of the conduit assembly becomes captively held between the second and third edges.

7. The portable blower according to claim 4 wherein the third edge is defined by a first cantilevered tab.

8. The portable blower according to claim 7 wherein the ring comprises an annular wall that extends around the first portion of the conduit assembly and the first cantilevered tab is formed by being struck from the annular wall so that the first cantilevered tab is formed as one piece with a part of the annular wall.

9. The portable blower according to claim 7 wherein the ring comprises at least two cantilevered tabs in addition to the first cantilevered tab that are configured the same, and function the same, as the first cantilevered tab.

10. The portable blower according to claim 1 wherein the first portion of the conduit assembly is made from a non-metal material and the ring is made from a metal material.

11. The portable blower according to claim 10 wherein the first portion of the conduit is made from high density polyethylene and the ring is made from steel.

12. The portable blower according to claim 11 wherein the ring is made from material having a gauge on the order of 22.

13. The portable blower according to claim 1 wherein the ring has an outside diameter of 2.5 to 3.5 inches.

14. The portable blower according to claim 13 wherein the first portion of the conduit assembly defines an annular corner on the rim extending fully around the discharge opening and the ring has transverse portions that cooperatively wrap around the annular corner.

15. The portable blower according to claim 1 wherein air moving through the discharge opening moves in a first line, and the ring extends fully around the discharge opening and has transverse surface portions each extending continuously around the discharge opening.

16. The portable blower according to claim 1 wherein the portable blower has a weight and size that allow the portable blower to be held and operated by a user in an elevated position and the conduit assembly one of: a) is configured so that the discharge opening is substantially fixed relative to the fluid propulsion unit whereby a user is required to reorient the portable blower to reposition the discharge opening relative to a surface against which fluid is to be propelled; and b) is configured so that a user can selectively reposition the discharge opening relative to the fluid propulsion unit to reposition the discharge opening relative to a surface against which fluid is to be propelled.

17. The portable blower according to claim 1 wherein the discrete component is in the form of a ring and the ring has a dimension along the first line that is substantially less than a dimension of the first portion of the conduit assembly along the first line.

18. The portable blower according to claim 1 wherein the first portion of the conduit assembly defines an annular corner on the rim extending around the discharge opening and the discrete component has transverse portions that cooperatively wrap around the annular corner.

19. The portable blower according to claim 18 wherein the discrete component is in the form of a ring with a central axis and one of the transverse portions extends radially inwardly from the other of the transverse portions.

20. A portable blower comprising:

a propulsion unit for continuously generating a supply of pressurized fluid; and a conduit assembly for controllably directing fluid from the propulsion unit to and through a discharge opening on the conduit assembly, the discharge opening having a central axis and a diameter, the discharge opening bounded by a rim, the rim defined at least partially by a discrete component made from a first material, the discrete component extending axially relative to the central axis a distance less than the diameter of the discharge opening, the conduit assembly comprising a first portion made from a second material to which the discrete component is operatively connected, the first material being at least one of: a) more resistant to abrasive wear than the second material; b) more resistant to impact than the second material; and c) harder than the second material, wherein the discrete component is in the form of a ring, wherein air moving through the discharge opening moves in a first line, the first portion of the conduit assembly defines a first edge on the rim facing in one direction generally parallel to the first line and the discrete component defines a second edge that extends transversely to the first line and abuts to the first edge with the discrete component operatively connected, wherein the ring comprises a third edge facing generally in the one direction and engages the first portion of the conduit assembly so that a part of the first portion of the conduit assembly is captively held in a fixed relationship between the second and third edges to thereby maintain the discrete component operatively connected, wherein the third edge is defined by a first cantilevered tab, wherein the third edge is configured to define spaced contact regions that each digs into the first portion of the conduit assembly.

21. The portable blower according to claim 20 wherein at least one of the contact regions is defined at the apex of a "V" shape on the first cantilevered tab with the "V" opening substantially axially.

22. The portable blower according to claim 21 wherein the first cantilevered tab has a perimeter edge that is in the shape of a "W" that defines spaced contact regions.

23. A portable blower comprising:

a propulsion unit for continuously generating a supply of pressurized fluid; and a conduit assembly for controllably directing fluid from the propulsion unit to and through a discharge opening on the conduit assembly, the discharge opening bounded by a rim, the rim defined at least partially by a discrete component made from a first material, the conduit assembly comprising a first portion made from a second material to which the discrete component is operatively connected, the first material being at least one of: a) more resistant to abrasive wear than the second material; b) more resistant to impact than the second material; and c) harder than the second material, wherein the discrete component is in the form of a ring, wherein the ring has a central axis, a diameter, and an axial length and the diameter is greater than the axial length of the ring, wherein the air moving through the discharge opening moves in a first line, the first portion of the conduit assembly defining a first edge on the rim facing in one direction generally parallel to the first line, wherein the discrete component defines a second edge that extends transversely to the first line and extends across the first edge with the discrete component operatively connected.

* * * * *